US009073375B2

(12) United States Patent
Takada

(10) Patent No.: US 9,073,375 B2
(45) Date of Patent: Jul. 7, 2015

(54) ERASING APPARATUS

(71) Applicants: Kabushiki Kaisha Toshiba, Tokyo (JP); Toshiba Tec Kabushiki Kaisha, Tokyo (JP)

(72) Inventor: Setsuo Takada, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/169,548

(22) Filed: Jan. 31, 2014

(65) Prior Publication Data

US 2014/0213444 A1 Jul. 31, 2014

(30) Foreign Application Priority Data

Jan. 31, 2013 (JP) ..... 2013-017300

(51) Int. Cl.
*B41J 29/16* (2006.01)
*B41M 5/30* (2006.01)
*F27B 9/40* (2006.01)

(52) U.S. Cl.
CPC . *B41M 5/305* (2013.01); *F27B 9/40* (2013.01)

(58) Field of Classification Search
USPC ..... 347/171, 179
See application file for complete search history.

(56) References Cited

U.S. PATENT DOCUMENTS

2013/0002782 A1* 1/2013 Kawaguchi et al. ..... 347/179
2013/0002783 A1 1/2013 Mizutani et al.

FOREIGN PATENT DOCUMENTS

JP H07-32624 2/1995
JP H09-152802 6/1997
JP 2002-214957 7/2002
JP 2013-011886 1/2013

OTHER PUBLICATIONS

Office Action mailed Sep. 30, 2014, filed in corresponding Japanese Patent Application No. 2013-017300, with English translation.
Office Action dated Mar. 4, 2015, filed in Japanese Patent Application No. 2013-017300, with English translation.

* cited by examiner

*Primary Examiner* — Kristal Feggins
(74) *Attorney, Agent, or Firm* — Patterson & Sheridan, LLP

(57) ABSTRACT

An erasing apparatus includes a conveyance path configured to convey a sheet on which an image is formed with a coloring agent which is erased by heating. A first erasing unit is disposed on the conveyance path and is configured to heat the sheet when the sheet is conveyed between a first heating component and a first press component. A second erasing unit is disposed on the conveyance path downstream from the first erasing unit and is configured to heat the sheet when the sheet is conveyed between a second heating component and a second press component. A control section is configured to control a temperature of the first heating component at a first temperature at which the image on the sheet can be erased and to control a temperature of the second heating component at a second temperature lower than the first temperature.

19 Claims, 4 Drawing Sheets

FIG.4

| ERASING TEMPERATURE TEMPERATURE T1 OF FIRST ERASING UNIT TEMPERATURE T2 OF SECOND ERASING UNIT | CURL OCCURRENCE CONDITION | CURL AMOUNT H2 (mm) |
|---|---|---|
| T1<T2 | x x | 30mm |
| T1=T2 | x | 20mm |
| T1>T2 | O | 5mm |

FIG.5

| EXAMPLE | TEMPERATURE T1 OF HEAT ROLLER 31 | TEMPERATURE T2 OF HEAT ROLLER 33 | CURL AMOUNT H2 | EVALUATION LEVEL |
|---|---|---|---|---|
| 1 | HIGH | HIGH | LARGE | x |
| 2 | HIGH | MODERATE | MODERATE | Δ |
| 3 | HIGH | LOW | SMALL | OOO |
| 4 | MODERATE | HIGH | LARGE | x x |
| 5 | MODERATE | MODERATE | MODERATE | Δ Δ |
| 6 | MODERATE | LOW | SMALL | OO |
| 7 | LOW | HIGH | LARGE | x x x |
| 8 | LOW | MODERATE | MODERATE | Δ Δ Δ |
| 9 | LOW | LOW | SMALL | O |

ERASING APPARATUS

CROSS-REFERENCE TO RELATED APPLICATION

This application is based upon and claims the benefit of priority from Japanese Patent Application No. 2013-017300, filed Jan. 31, 2013, the entire contents of which are incorporated herein by reference.

FIELD

Embodiments described herein relate to an erasing apparatus for erasing an image formed on a sheet by an image forming apparatus.

BACKGROUND

Conventionally, an image is formed on a sheet (paper) using an image forming apparatus such as a MFP (Multi-Function Peripheral). Further, in order to erase an image formed on a sheet to reuse the sheet, an image is printed on the sheet with a color-erasable coloring agent such as ink containing leuco dye.

The color-erasable coloring agent can be erased by heating at a sufficiently high temperature. Thus, to be reused, the sheet is heated using an erasing apparatus to erase the image formed thereon. The aforementioned erasing of an image formed on a sheet is hereinafter referred to as 'color erasing'.

In the erasing apparatus, a heat roller and a press roller are oppositely arranged across a sheet conveyance path, and a sheet is conveyed and heated between the heat roller and the press roller, thereby erasing a color-erasable coloring agent. Further, two erasing units, each consisting of the heat roller and the press roller, are respectively arranged at the upstream side and the downstream side of the sheet conveyance path to erase colors on both sides of the sheet.

However, if the erasing temperature of the erasing unit at the downstream side is increased to completely erase colors of the images on both sides of a sheet through a single color erasing operation, a problem arises in that the sheet is curled, which leads to a paper jam in the erasing apparatus.

It is deemed that the reason for the curl of the sheet lies in the change in the stretching rate of the sheet caused by the difference in the moisture between the front side and the back side of the sheet. The more the erasing temperature of the erasing unit at the downstream side is increased, the elasticity difference between the front surface and the back surface of the sheet increases, and the curl amount increases.

BRIEF DESCRIPTION OF THE DRAWINGS

FIG. 4 is a diagram illustrating the relation between an erasing temperature and the curl amount of a sheet; and FIG. 5 is a diagram illustrating an example of results of changing temperatures of a first and a second erasing unit, according to an embodiment.

DETAILED DESCRIPTION

An erasing apparatus includes a conveyance path configured to convey a sheet on which an image is formed with a coloring agent which is erased by heating. A first erasing unit is disposed on the conveyance path and is configured to heat the sheet when the sheet is conveyed between a first heating component and a first press component arranged on opposite sides of the conveyance path. A second erasing unit is disposed on the conveyance path downstream from the first erasing unit and is configured to heat the sheet when the sheet is conveyed between a second heating component and a second press component arranged on opposite sides of the conveyance path. The second heating component and the second press component are arranged with respect to the conveyance path in reverse positions compared to the first heating component and the first press component, respectively. A control section is configured to control a temperature of the first heating component at a first temperature at which the image on the sheet can be erased and to control a temperature of the second heating component at a second temperature lower than the first temperature.

Embodiments are described below with reference to accompanying drawings. Additionally, in each of the accompanying drawings, the same reference symbol denotes the same component.

(Embodiment 1)

Figure 1:
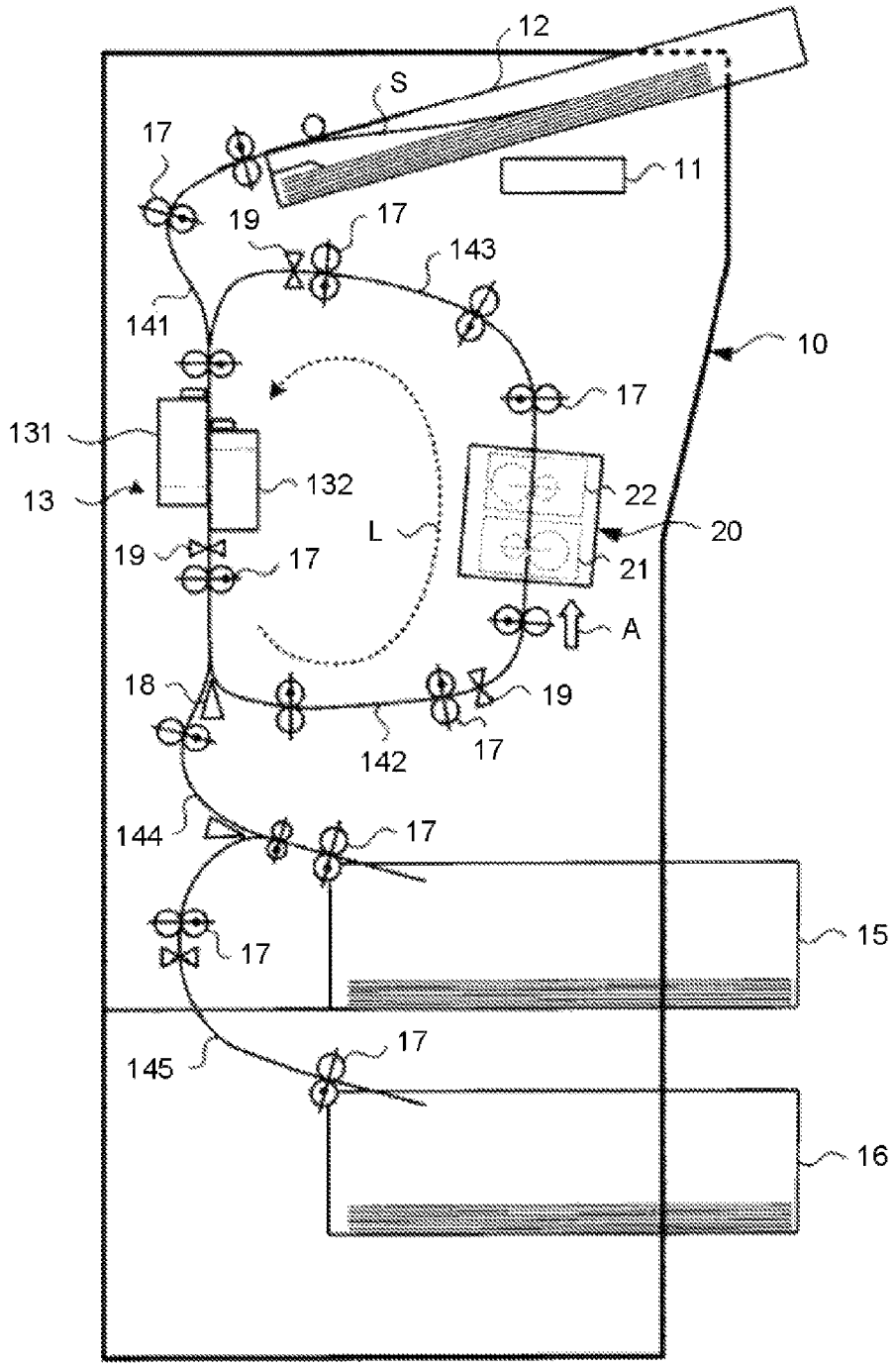
FIG. 1 is a diagram illustrating an erasing apparatus, according to an embodiment.

FIG. 1 is a diagram illustrating an erasing apparatus according to a first embodiment. An erasing apparatus 10 includes an operation panel 11 including operation buttons and a display section, a paper feed tray 12, a scanner 13 serving as a reading section and an erasing section 20.

The operation panel 11 has a touch panel type display section and various operation keys which include, for example, a numeric key, a stop key and a start key. A user operates the operation panel 11 to instruct operations such as the starting of color erasing or reading the image on a sheet to be erased. The operation panel 11 is also capable of displaying the setting information, the operation status of the erasing apparatus 10, the log information or a message sent to a user.

Further, the operation panel 11, which is not limited to be arranged on the main body of the erasing apparatus 10, may further be operated through an operation section of an external apparatus connected with the erasing apparatus 10 via a network. Alternatively, the operation panel may be independent from the main body of the erasing apparatus to operate the erasing apparatus 10 through wired or wireless communication.

The paper feed tray 12 stacks reusable sheets. Sheets of different sizes (e.g. A4, A3, B5) are stacked on the paper feed tray 12. The sheet stacked on the paper feed tray 12 is a sheet on which an image is formed with a color-erasable coloring agent, the color of which is erased when heated at a temperature above a given temperature.

The color-erasable coloring agent contains a color generation compound, a color developing agent and a color erasing agent. The color generation compound is, for example, leuco dye. The color developing agent is, for example, phenols. The color erasing agent is, for example, a material which, when heated, is compatible with the color generation compound and has no affinity for the color developing agent. The color-erasable coloring agent generates a color through the interaction of the color generation compound and the color developing agent and is erased after being heated at a temperature higher than a color erasing temperature to eliminate the interaction of the color generation compound and the color developing agent.

The paper feed tray 12 feeds, one by one, sheets to a first conveyance path 141 through a pickup roller, a sheet feed roller and a separation roller. The scanner 13, which has a reading unit such as a CCD (Charge Coupled Device) or a CMOS sensor, includes a first scanner 131 and a second scanner 132 for reading each image on the first and the second surface of a conveyed sheet.

In addition to the first conveyance path 141, the erasing apparatus 10 further includes a second conveyance path 142, a third conveyance path 143, a fourth conveyance path 144, a fifth conveyance path 145, a first paper discharging tray 15 and a second paper discharging tray (reject tray) 16. Each of the conveyance paths 141-145 includes a plurality of conveyance rollers 17 for conveying a sheet. The plurality of conveyance rollers 17 are rotationally driven by a motor 41 (refer to FIG. 2), respectively. Further, to distribute the conveyance of a sheet towards the conveyance paths 142 and 144, agate 18 is arranged as switch for changing the conveyance path of the sheet.

The first conveyance path 141 conveys a sheet S from the paper feed tray 12 to the scanner 13. The second conveyance path 142 conveys the sheet S from the scanner 13 towards the erasing section 20 along the direction indicated by an arrow A. The third conveyance path 143 conveys the sheet S from the erasing section 20 to the scanner 13 again. The fourth conveyance path 144 conveys the sheet S from the scanner 13 to the first paper discharging tray 15. The fifth conveyance path 145 conveys the sheet S from the scanner 13 to the reject tray 16. The first paper discharging tray 15 collects a sheet which is reusable after, for example, an image erasing processing. The reject tray 16 collects a rejected, not-reusable sheet.

Further, the erasing apparatus 10 is provided with a plurality of sensors 19 for detecting the sheets conveyed in the first conveyance path 141 to the fifth conveyance path 145. The sensors 19, which may be, for example, micro sensors or micro actuators, are arranged at proper positions of the conveyance paths.

The erasing apparatus 10 shown in FIG. 1 substantially carries out the following operations.

First, when a color-erasing and reading mode is selected for a sheet S using the operation section 11, the sheet S is conveyed from the paper feed tray 12 to the scanner 13 (serving as a reading section) through the first conveyance path 141. The image of the sheet S is scanned by the scanner 13, and image data is read before the image of the sheet S is erased. Further, the printing rate of the sheet S is calculated. The scanner 13 reads two sides of the sheet S using the first scanner 131 and the second scanner 132. In addition, the scanner 13 reads the printing condition of the sheet S.

The image data read by the scanner 13 is stored in a storage section 42 (refer to FIG. 2) and, if needed, is read again from the storage section 42 to form an image. Further, if the printing condition read by the scanner 13 shows that there is a rip or wrinkle on the sheet S, the sheet S is guided to the fifth conveyance path 145 and conveyed to the reject box 16. Further, a sheet which is high in printing rate is likely to curl when being erased, and is therefore also conveyed to the reject box 16. A rip-free and wrinkle-free sheet S is conveyed to the erasing section 20 through the second conveyance path 142.

The sheet S conveyed to the erasing section 20 is heated when passing through the erasing section 20 so as to erase the image formed on the sheet S by heating. The erasing section 20 erases the image on the sheet S by heating and pressing the sheet S at a relatively high temperature of, for example, 180-220 degrees centigrade. A color-erasable agent, which is erased when heated at a given temperature, is used in the formation of an image on the sheet S. Thus, the color of the sheet S can be erased by conveying, at a preset conveyance speed, the sheet S in the erasing section 20 which heats the sheet at a given temperature.

The sheet S passing through the erasing section 20 is conveyed to the scanner 13 again through the third conveyance path 143. The scanner 13 reads the printing condition again to confirm whether or not the image formed with the color-erasable agent is indeed erased and then sorts the sheet.

A reusable sheet S is conveyed to the first paper discharging tray 15 via the fourth conveyance path 144. Further, a non-reusable sheet S (i.e., a sheet which is determined to have a residual image formed with a color-inerasable agent or a hand-drawn image in an image area in addition to a rip or wrinkles according to the printing condition read by the scanner 13) is conveyed to reject box 16 through the fifth conveyance path 145.

Further, whether or not the data of the image on the sheet read by the scanner 13 contains data which is forbidden to be erased, such as confidential data, is determined. If the data read by the scanner 13 contains data which is forbidden to be erased, the sheet S is conveyed to the reject box 16. The first paper discharging tray 15 and the reject box 16 constitute a paper discharging section.

The erasing section 20, which is described in detail with reference to FIG. 3, includes a first erasing unit 21 having a heat roller (heating component) 31 and a press roller (press component) 32 and a second erasing unit 22 having a heat roller (heating component) 33 and a press roller (press component) 34 and conveys and heats a sheet S by clamping the sheet S between the heat roller 31 and the press roller 32 and between the heat roller 33 and the press roller 34. The heat rollers 31 and 33 have internal heat sources and temperature detection section 35 and 36 on the outside periphery thereof. The heat source may be, for example, a halogen lamp.

The erasing section 20 heats a sheet to a given color erasing temperature to erase the image formed on the sheet. Further, the erasing section 20 erases the colors of the first surface and the second surface of a sheet with the two erasing units 21 and 22.

Figure 2:
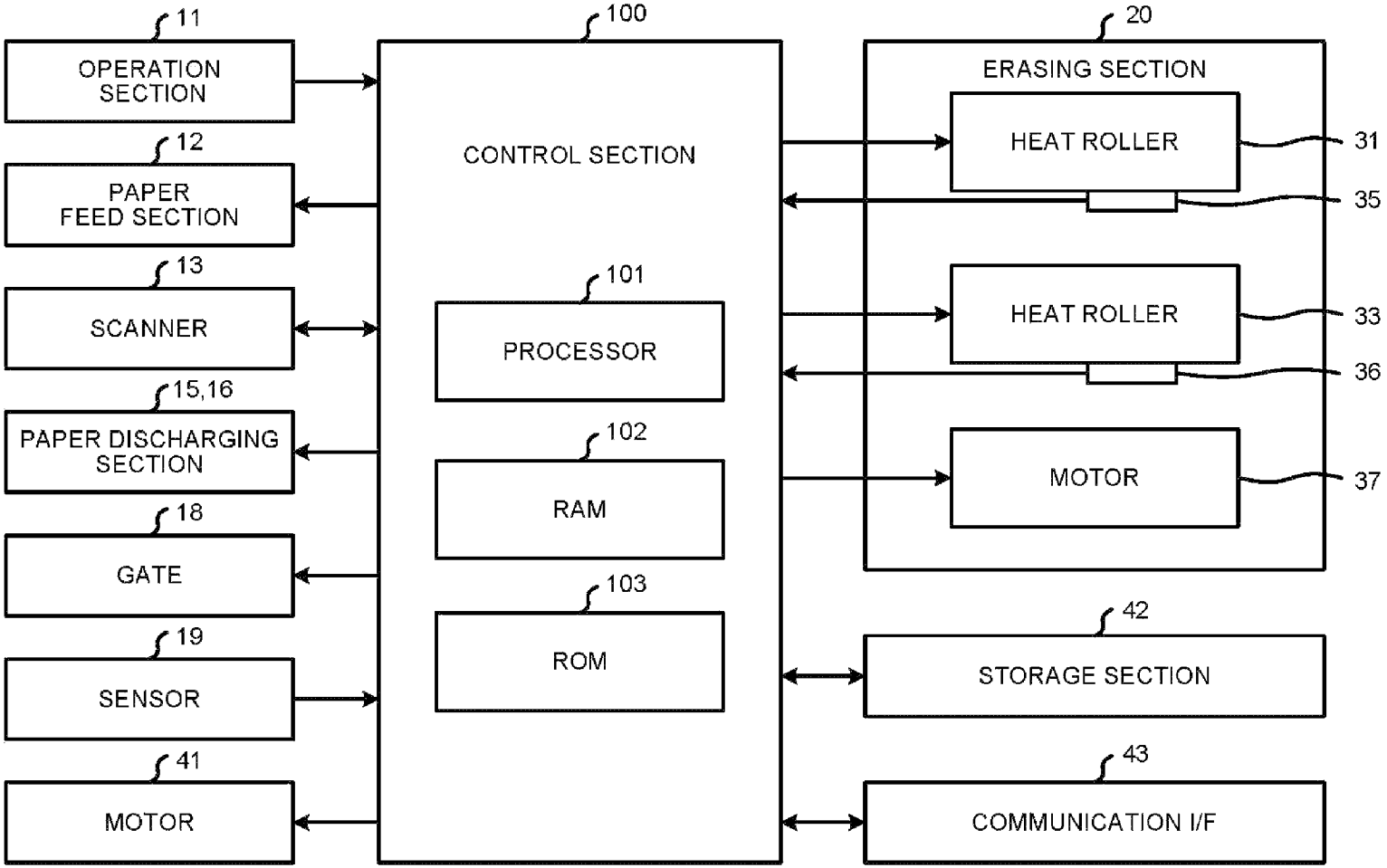
FIG. 2 is a block diagram illustrating a control system of the erasing apparatus.

FIG. 2 is a block diagram illustrating the control system of the erasing apparatus 10 according to an embodiment. The erasing apparatus 10 includes a control section 100. The control section 100 includes a processor 101 including a CPU (Central Processing Unit) or a MPU (Micro Processing Unit), a random access memory (RAM) 102 and a read only memory (ROM) 103.

The processor 101 executes the control program stored in the ROM 103. The RAM 102, which is a main memory functioning as a working memory, provides a temporary work area for the processor 101. The RAM 102 may also store the image read by the scanner 13 temporarily. The ROM 103 stores control programs and control data controlling the operations of the erasing apparatus 10. For example, the ROM 103 stores a paper printing rate which serves as a threshold value for determining whether or not a sheet can be reused. The ROM 103 also stores a density threshold value for determining whether or not an image is erased.

The control section 100 controls the position of a sheet S based on an instruction from the operation panel 11 and a detection result from the sensor 19 and controls the paper feed tray 12, the scanner 13, the paper discharging sections 15 and 16, the motor 41 and the gate 18. Further, the operation panel 11 includes, for example, an erasing start button to give an instruction of erasing the sheet S. The paper feed tray 12 feeds, one by one, sheets on which an image is formed, to the erasing apparatus 10. The scanner 13 reads and stores the image of the fed sheet and reads the printing state of the sheet. Further, the scanner 13 determines whether or not the color of the sheet passing through the erasing section 20 is erased based on the reading result.

The control section 100 controls the rotation of the motor 41 to drive the conveyance rollers 17 of the first to the fifth conveyance paths 141-145, thereby controlling the conveyance of a sheet S. Further, the control section 100 controls the gate 18 to distribute the conveyance of a sheet S to a selected conveyance path. Then, the control section 100 carries out a control to discharge a color-erased sheet to the paper discharging section 15 and a sheet which is not erased or is ripped or wrinkled to the paper discharging section 16.

The control section 100 controls the 'on' and 'off' state of the heat sources of the heat rollers 31 and 33. Temperature detecting elements 35 and 36 such as thermistors are arranged on the heat rollers 31 and 33, respectively. The control section 100 controls temperatures of the heat rollers 31 and 33 in response to temperature detection results of the temperature detecting elements 35 and 36 to prevent overheating. The control section 100 also controls a motor 37 for rotationally driving the heat rollers 31 and 33.

Further, the control section 100 is connected with the storage section 42 and a communication interface (I/F) 43. The storage section 42 stores application programs and an OS. The application programs include programs for executing the functions of the erasing apparatus 10, such as the reading function of the scanner 13 and the color erasing function of the erasing section 20. Further, the storage section 42 stores the image read by the scanner 13 as well as the number of the sheets processed by the erasing apparatus 10.

The communication I/F 43 is an interface for connection with an external device. The control section 100 communicates with a compound machine or other external device via the communication I/F 43 to store, for example, the image read by the scanner 13 in the storage section of a user terminal (personal computer), a compound machine, or a server serving as an external device.

Figure 3:
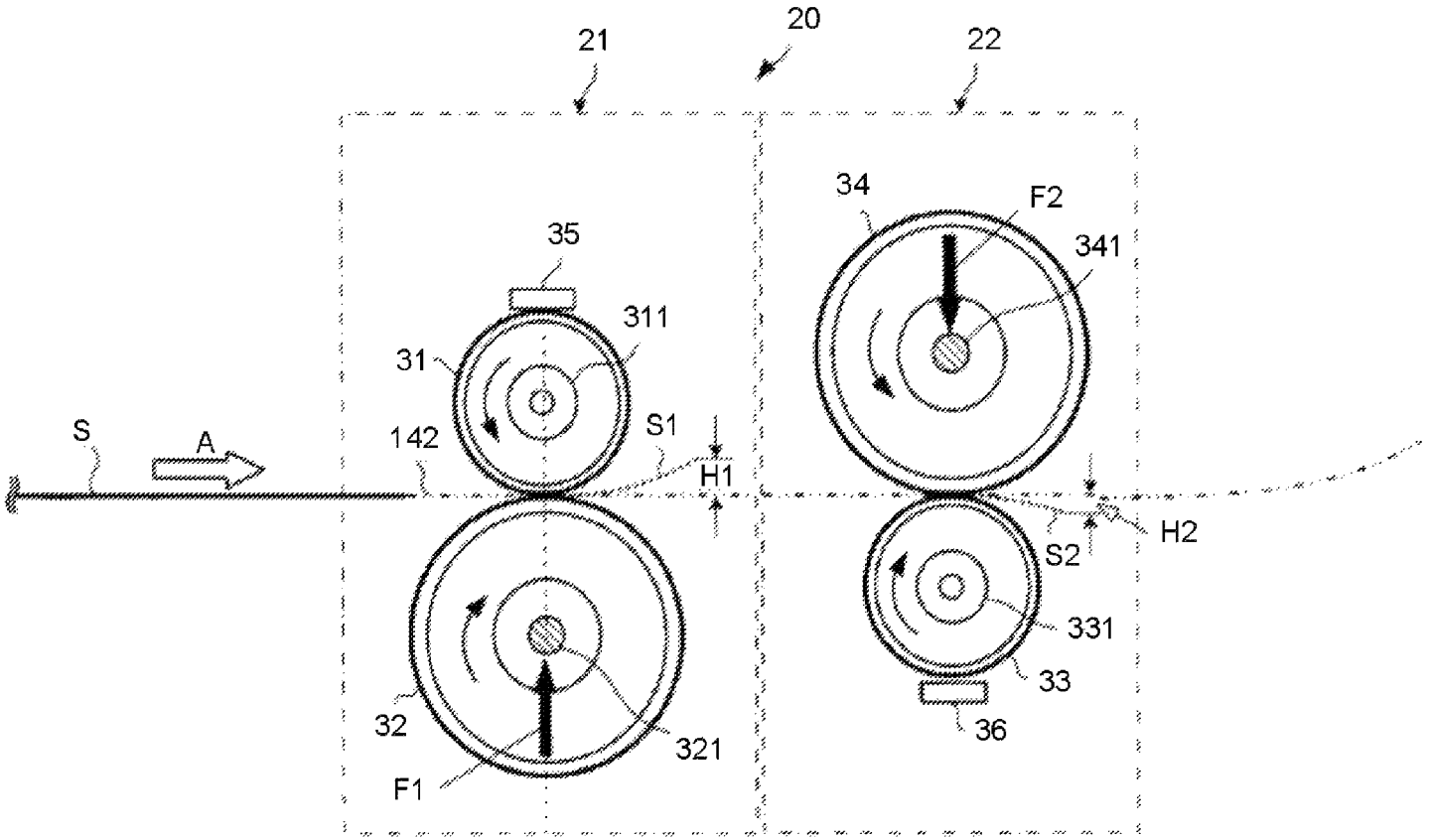
FIG. 3 is a side view illustrating an erasing section of the erasing apparatus according to the embodiment.

FIG. 3 is a side view illustrating the specific arrangement of the erasing section 20. In FIG. 3, the heat roller (heating component) 31 and the press roller (press component) 32 are used as the first erasing unit 21. The heat roller 31 has a diameter smaller than that of the press roller 32. The heat roller 31 and the press roller 32 are oppositely arranged. In other words, taking the second conveyance path 142 represented by a two dotted lines as the center, the heat roller 31 and the press roller 32 are located in a direction orthogonal to the conveyance direction of sheets S. Further, the heat roller 31 contacts with the first side (e.g. front side) of a sheet S, and the shaft 321 of the press roller 32 is pressed with the force of, for example, a spring towards the direction of the heat roller (indicated by the arrow F1).

Similarly, the second erasing unit 22 located at the downstream side of the first erasing unit 21 includes the heat roller (heating component) 33 and the press roller (press component) 34, and the heat roller 33 has a diameter smaller than that of the press roller 34. The heat roller 33 and the press roller 34 are arranged in a direction orthogonal to the conveyance direction of sheets S. The press roller 34 presses a shaft 341 with the force of, for example, a spring towards the direction of the heat roller 33 (indicated by an arrow F2).

As described above in connection with the first erasing unit 21, the heat roller 33 and the press roller 34 are oppositely arranged about second conveyance path 142. However, the arrangement positions thereof are reverse to those of the heat roller 31 and the press roller 32 of the first erasing unit 21. That is, the heat roller 31 is located at the first side (e.g. a front side) of a sheet S, and the heat roller 33 is located at the second side (e.g. a back side) of the sheet S. Likewise, the positions of the heat rollers 31, 33 and the positions of the press rollers 32, 34 are reverse.

The heat roller 31 contacts with the press roller 32 and the heat roller 33 contacts with the press roller 34 if there is no sheet S. The cylindrical heat rollers 31 and 33 are respectively provided with internal heat sources 311 and 331, which may be, for example, halogen lamps. Further, the motor 37 (refer to FIG. 2) rotates the heat roller 31 counter-clockwise and rotates the heat roller 33 clockwise so that the heat rollers 31 and 33 are rotated along the conveyance direction of a sheet S. The press rollers 32 and 34 are driven to rotate by the rotation of the heat rollers 31 and 33. The rotation of the motor 37 is separately transferred to the heat rollers 31 and 33 through a transmission mechanism such as a gear.

The first erasing unit 21 heats a sheet S from the first side of the sheet S, and the second erasing unit 22 heats the sheet S from the second side of the sheet. That is, the erasing section 20 erases the images on two sides of a conveyed sheet S during a single conveyance process. Further, temperature detecting elements 35 and 36 such as thermistors are arranged on the heat rollers 31 and 33, respectively. The temperature detecting elements 35 and 36 detect temperatures of the heat rollers 31 and 33, and the control section 100 controls temperatures of the heat sources 311 and 331 based on the detection result to control surface temperatures of the heat rollers 31 and 33. That is, the control section 100 compares the detection result of the temperature detecting elements 35 and 36 with a preset reference temperature, turns the heat sources 311 and 331 on if the temperatures detected by the temperature detecting elements 35 and 36 are lower than the reference temperature, and turns the heat sources 311 and 331 off if the temperatures detected by the temperature detecting elements 35 and 36 are higher than the reference temperature.

In the arrangement shown in FIG. 3, the image on the first side (e.g. front side) of a sheet S is erased by the first erasing unit 21 when the sheet S passes through the space between the heat roller 31 and the press roller 32. At this time, as heat is also transferred to the second side of the sheet S, the image on the second side (e.g. back side) is almost erased. Further, the residual image which is not erased on the second side of the sheet S is also erased by the second erasing unit 22.

However, a sheet S may curl when passing through the erasing unit 21 at the upstream side and the erasing unit 22 at the downstream side. That is, the front side of a sheet S is heated by the heat roller 31 when the sheet S passes through the erasing unit 21, thus, a moisture difference appears in the front side and the back side of the sheet, causing a change in stretching rate, which leads to the curling of the sheet S. Further, as the heat roller 31 is made from a hard material and the press roller 32 is made from a soft material (e.g. rubber), the sheet S is easily wound on the hard heat roller 31, and as shown by the dotted line S1 in FIG. 3, the sheet S curls towards the direction of the heat roller 31. At this time, the curl amount is set to be H1.

Further, the curled sheet S is conveyed to the erasing unit 22 at the downstream side, and the curl is straightened by the erasing unit 22. The back side of the sheet S is heated by the heat roller 33 when the sheet S passes through the erasing unit 22. Again, the sheet S curls due to the moisture difference in the front side and the back side of the sheet S. Further, as the heat roller 33 is made from a hard material and the press roller 34 is made from a soft material (e.g. rubber), the sheet S is easily wound on the hard heat roller 33, and as shown by the dotted line S2 in FIG. 3, the sheet S curls towards the direction of the heat roller 33. At this time, the curl amount is set to be H2.

Besides, if the curl amount generated in the erasing unit 21 at the upstream side is too large, the sheet may hit the press roller 34 of the erasing unit 22 at the downstream side, which leads to a paper jam. To prevent the curling, a method is available according to which erasing temperatures of the erasing units 21 and 22 are lowered; however, if the erasing temperatures are lowered, the image on the sheet cannot be erased and erasing residual remains. Therefore, a temperature setting is needed which takes into consideration of both image erasing and curling reduction.

In embodiments described herein, the erasing temperature of the first erasing unit 21 is set to be relatively high while that of the second erasing unit 22 is set to be relatively low, thereby exactly erasing an image and reducing the possibility of the occurrence of curling.

The erasing temperature of the first erasing unit 21, at which the image formed on a sheet S can be exactly erased, is set in a temperature range from, for example, 180 degrees centigrade to 200 degrees centigrade. Further, the erasing temperature of the second erasing unit 22 is set to be lower than the aforementioned temperature range. That is, in the first erasing unit 21, in order to erase the image on the first side of a sheet S, the sheet S is heated within the set temperature range. At this time, as the second side of the sheet S is heated as well, the image on the second side is almost erased.

As noted, before being conveyed to the second erasing unit 22, the sheet S is pre-heated by the first erasing unit 21. Thus, even if the erasing temperature of the second erasing unit 22 is set to be lower than that of the first erasing unit 21, the image remaining on the sheet S (especially the image remaining on the second side of the sheet S) can be completely erased. Moreover, by lowering the erasing temperature of the second erasing unit 22, the possibility of the occurrence of the curl can be reduced as well. The erasing temperature, which refers to a temperature at which the image on the sheet S is erased, is equivalent to the surface temperatures of the heat rollers 31 and 33.

FIG. 4 is a diagram illustrating the relation between an erasing temperature and the curl amount of a sheet.

In FIG. 4, if the erasing temperature of the first erasing unit 21 is set to be T1 and that of the second erasing unit 22 is set to be T2, the curl occurrence condition and the curl amount (mm) in the second erasing unit 22 generated when T1<T2, or T1=T2, or T1>T2 are shown in FIG. 4. In the curl occurrence condition, the more the marks 'x' are, the larger the curl amount is, and moreover, the curl amount is out of an allowable range. A mark '○' represents that the curl amount is within the allowable range.

It can be known from FIG. 4 that an excellent effect can be achieved when T1>T2, that is, when the erasing temperature of the first erasing unit 21 is set to be high and the erasing temperature of the second erasing unit 22 is set to be lower than that of the first erasing unit 21.

Consequentially, by reducing the temperature difference of the front side and the back side of the sheet while setting the temperature at the downstream side to be lower than that at the upstream side, the stretching of the front side and the back side of the sheet S is less at the downstream side, thus, the curl amount is reduced. Contrarily, when the temperature at the downstream side is set to be high, the stretching difference of the front side and the back side of the sheet is increased, which leads to curling and deterioration.

For example, by setting the color erasing temperature of the first erasing unit 21 to be 180 degrees centigrade and that of the second erasing unit 22 to be 160 degrees centigrade, the curl amount can be reduced to the allowable range. The more the erasing temperature of the second erasing unit 22 is reduced, the more the curl amount is reduced. However, if the erasing temperature of the second erasing unit 22 is set too low, erasing residual remains. Therefore, it is necessary to set the erasing temperature of the second erasing unit 22 to be within a range at which the curl amount can be reduced while no erasing residual remains.

FIG. 5 is a diagram illustrating an example of results of changing the temperature T1 of the heat roller 31 of the first erasing unit 21 and the temperature T2 of the heat roller 33 of the second erasing unit 22. Nine examples are shown in FIG. 5. A 'high' temperature refers to the high temperature within a temperature range (e.g. 180-200 degrees centigrade) at which the image formed on a sheet S can be erased. A 'moderate' temperature refers to the moderate temperature in the temperature range at which the image formed on a sheet S can be erased. A 'low' temperature refers to the low temperature in the temperature range at which the image formed on a sheet S can be erased.

Further, the curl amount, which refers to the curl amount H2 of a sheet passing through the second erasing unit 22, is represented by three levels of 'large', 'moderate' and 'small'. Further, as to evaluation level, the more the marks 'x' are, the larger the curl amount is, and moreover, the curl amount is out of the allowable range. A Δ represents that the curl amount is out of, but close to, the allowable range, and ○ represents that the curl amount is within the allowable range. The more the marks '○' and 'Δ' are, the better the effect is.

It can be seen from FIG. 5 that the effect of example 3 is the best and the effect of example 6 is pretty good. In examples 7-9, as the erasing temperature is extremely low, the image on a sheet cannot be completely erased, thus, examples 7-9 are not preferred. The following results are obtained from examples 1-3.

In example 1, an upward curl (S1 shown in FIG. 3), which occurs in the first erasing unit 21, is straightened in second erasing unit 22. However, as the erasing temperature of the second erasing unit 22 is 'high,' the amount of the downward curl (S2 shown in FIG. 3) occurring in the second erasing unit 22 is 'large.' Thus, the evaluation is 'x.'

In example 2, an upward curl, which occurs in the first erasing unit 21, is straightened in second erasing unit 22. However, as the erasing temperature of the second erasing unit 22 is 'moderate,' the amount of the downward curl occurring in the second erasing unit 22 is 'moderate.' Thus, the evaluation is 'Δ.'

In example 3, an upward curl, which occurs in the first erasing unit 21, is straightened in second erasing unit 22. However, as the erasing temperature of the second erasing unit 22 is 'low', the amount of the downward curl occurring in the second erasing unit 22 is 'small.' Thus, the evaluation is '○.'

Further, the erasing temperature of the second erasing unit 22 may also be lower than the temperature range at which an image can be erased. That is, as a sheet S is preheated in the first erasing unit 21, a residual image can be completely erased even if the erasing temperature in the second erasing unit 22 is lower than the temperature range at which an image can be erased. Besides, the curl amount can be reduced by a value corresponding to the drop of the erasing temperature of the second erasing unit 22.

In example 6, an upward curl occurs in the first erasing unit 21. The amount of the curl is reduced by a value corresponding to the drop of the temperature. Further, the upward curl is straightened in the second erasing unit 22. Because the erasing temperature of the second erasing unit 22 is 'low,' the amount of the downward curl occurring in the second erasing unit 22 is 'small.' Thus, the evaluation is '○'. However, in view of the reliability of image erasing, the number of the marks '○' is less than that of the marks in example 3. Further, the erasing temperature of the second erasing unit 22 may also be below the temperature range at which an image can be erased.

As stated above, by setting the erasing temperature of the first erasing unit 21 to be within a temperature range at which an image can be erased and the erasing temperature of the second erasing unit 22 to be lower than that of the first erasing unit 21, an image can be exactly erased while the possibility of the occurrence of a curl is reduced.

Further, as shown in FIG. 1, the first, the second and the third conveyance paths (141-143) of the erasing apparatus 10 form a loop L, along which a sheet S is likely to curl. Thus, if a curl occurs in the second erasing unit 22 in a direction reverse to the loop L, then the curl can be totally straightened. That is, if the loop L is counterclockwise, then a curl occurring in the second erasing unit 22 can be set to be in a clockwise direction. As shown in FIG. 3, as the curl S2 occurring in the second erasing unit 22 is opposite to the direction of the loop L, the curl can be totally straightened.

Further, in the embodiments described above, the second erasing unit 22 is arranged at the downstream side of the first erasing unit 21. The interval between the first erasing unit 21 and the second erasing unit 22 is a distance enough for the heat roller 31 and the press roller 32, and the heat roller 33 and the press roller 34 to synchronously clamp a sheet having a minimum length. For example, the interval between the nips of the first erasing unit 21 and the second erasing unit 22 is 60 mm.

Further, the erasing apparatus described herein may also be integrally assembled in an image forming apparatus.

According to the embodiments described above, the image formed on a sheet can be exactly erased while the possibility of the occurrence of a curl is reduced.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An erasing apparatus, comprising:

a conveyance path configured to convey a sheet on which an image is formed with a coloring agent which is erased by heating;

a first erasing unit disposed on the conveyance path and configured to heat the sheet when the sheet is conveyed between a first heating component and a first press component arranged on opposite sides of the conveyance path;

a second erasing unit disposed on the conveyance path downstream from the first erasing unit and configured to heat the sheet when the sheet is conveyed between a second heating component and a second press component arranged on opposite sides of the conveyance path so that the sheet passing through the second erasing unit curls in a direction reverse to the direction of a loop formed by the conveyance path, wherein the second heating component and the second press component are arranged with respect to the conveyance path in reverse positions compared to the first heating component and the first press component, respectively; and a control section configured to control a temperature of the first heating component at a first temperature at which the image on the sheet can be erased and to control a temperature of the second heating component at a second temperature lower than the first temperature.

2. The erasing apparatus according to claim 1, wherein the first temperature is within a temperature range at which the image on the sheet can be erased and the second temperature is lower than the temperature range.

3. The erasing apparatus according to claim 1, wherein the first temperature and the second temperature are both within a temperature range at which the image on the sheet can be erased.

4. The erasing apparatus according to claim 3, wherein the first and second heating components are heat rollers and the first and second press components are press rollers.

5. The erasing apparatus according to claim 1, wherein the control section controls the temperatures of the first and second heating components so that a curl of the sheet exiting the second erasing unit is approximately 5 mm or less.

6. The erasing apparatus according to claim 1, wherein the control section controls the temperatures of the first and second heating components in order to minimize a curl of the sheet exiting the second erasing unit, the curl being caused by a difference in a moisture content of a first side of the sheet and a moisture content of a second side of the sheet.

7. The erasing apparatus according to claim 1, wherein the first erasing unit and the second erasing unit are positioned on the conveying path so that a sheet having a predetermined minimum length can be simultaneously clamped between the first heating component and the first press component, and the second heating component and the second press component.

8. An erasing apparatus, comprising:

a paper feed section configured to feed a sheet on which an image is formed with a coloring agent which is erased by heating;

a reading section configured to read the image formed on the sheet;

a first conveyance path configured to convey the sheet from the paper feed section to the reading section;

a second conveyance path configured to convey the sheet from the reading section;

a first erasing unit disposed on the second conveyance path downstream from the reading section and configured to heat the sheet when the sheet is conveyed between a first heating component and a first press component arranged on opposite sides of the conveyance path;

a second erasing unit disposed on the second conveyance path downstream from the first erasing unit and configured to heat the sheet when the sheet is conveyed between a second heating component and a second press component arranged on opposite sides of the conveyance path so that the sheet passing through the second erasing unit curls in a direction reverse to the direction of a loop formed by the first, the second and third conveyance paths, wherein the second heating component and the second press component are arranged with respect to the conveyance path in reverse positions compared to the first heating component and the first press component, respectively;

a third conveyance path configured to convey the sheet from the first and the second erasing units to the reading section;

a paper discharging section configured to determine whether the sheet is reusable based on the image read by the reading section and to then discharge the sheet; and a control section configured to control a temperature of the first heating component at a first temperature at which the image on the sheet can be erased and to control a temperature of the second heating component at a second temperature lower than the first temperature.

9. The erasing apparatus according to claim 8, wherein the first temperature is within a temperature range at which the image on the sheet can be erased and the second temperature is lower than the temperature range.

10. The erasing apparatus according to claim 8, wherein the first temperature and the second temperature are both within a temperature range at which the image on the sheet can be erased.

11. The erasing apparatus according to claim 10, wherein the first and second heating components are heat rollers and the first and second press components are press rollers.

12. The erasing apparatus according to claim 10, wherein the control section controls the temperatures of the first and second heating components so that a curl of the sheet exiting the second erasing unit is approximately 5 mm or less.

13. The erasing apparatus according to claim 10, wherein the control section controls the temperatures of the first and second heating components in order to minimize a curl of the sheet exiting the second erasing unit, the curl being caused by a difference in a moisture content of a first side of the sheet and a moisture content of a second side of the sheet.

14. A method of erasing a sheet on which an image is formed with a coloring agent which is erased by heating, the method comprising:

conveying the sheet to a first erasing unit;

heating the sheet in the first erasing unit as the sheet is conveyed between a first heating component and a first press component arranged on opposite sides of a conveyance path;

conveying the sheet to a second erasing unit disposed on the conveyance path downstream from the first erasing unit;

heating the sheet in the second erasing unit as the sheet is conveyed between a second heating component and a second press component arranged on opposite sides of the conveyance path so that the sheet passing through the second erasing init curls in a direction reverse to the direction of a loop formed by the conveyance path, wherein the second heating component and the second press component are arranged with respect to the conveyance path in reverse positions compared to the first heating component and the first press component, respectively;

controlling a temperature of the first heating component at a first temperature at which the image on the sheet can be erased; and controlling a temperature of the second heating component at a second temperature lower than the first temperature.

15. The method according to claim 14, wherein the first temperature is within a temperature range at which the image on the sheet can be erased and the second temperature is lower than the temperature range.

16. The method according to claim 14, wherein the first temperature and the second temperature are both within a temperature range at which the image on the sheet can be erased.

17. The method according to claim 14, wherein the first and second heating components are heat rollers and the first and second press components are press rollers.

18. The method according to claim 14, wherein the temperatures of the first and second heating components are controlled so that a curl of the sheet exiting the second erasing unit is approximately 5 mm or less.

19. The method according to claim 14, wherein the temperatures of the first and second heating components are controlled to minimize a curl of the sheet exiting the second erasing unit, the curl being caused by a difference in a moisture content of a first side of the sheet and a moisture content of a second side of the sheet.

* * * * *